US005722507A

United States Patent [19]

Kain

[11] Patent Number: 5,722,507

[45] Date of Patent: Mar. 3, 1998

[54] STEP STOOL ASSEMBLY

[75] Inventor: James M. Kain, Tipp City, Ohio

[73] Assignee: Cosco, Inc., Columbus, Ind.

[21] Appl. No.: 585,153

[22] Filed: Jan. 11, 1996

[51] Int. Cl.[6] ..... E06C 7/14

[52] U.S. Cl. ..... 182/129; 182/165; 182/104; 182/25

[58] Field of Search ..... 182/180, 161, 182/165, 25, 129, 115, 104

[56] References Cited

U.S. PATENT DOCUMENTS

| | | | |
|---|---|---|---|
| 162,075 | 4/1875 | Isaacs | 182/129 |
| 970,690 | 9/1910 | Davis | 182/129 |
| 1,440,645 | 1/1923 | Sullivan | 182/129 |
| 1,702,249 | 2/1929 | Davidson | 182/129 |
| 2,109,886 | 3/1938 | Lewis | 182/129 |
| 4,485,892 | 12/1984 | Maloney et al. . | |
| 5,419,409 | 5/1995 | Corulla | 182/129 |

OTHER PUBLICATIONS

Cosco 1995 Home Furnishings Catalog (Cover and pp. 2, 3) (1995).

*Primary Examiner*—Alvin C. Chin-Shue

*Attorney, Agent, or Firm*—Barnes & Thornburg

[57] ABSTRACT

A platform stool is provided including a frame having a front leg and a rear leg. The front leg is pivotably coupled to the rear leg for movement about a leg pivot axis between an opened position and a closed position. The platform stool includes a multi-part platform including a front section pivotably coupled to the front leg and a rear section pivotably coupled to the rear leg, each of the front and rear sections having a top surface. A platform support linkage couples the front section to the rear section for movement about a platform pivot axis between a platform-forming position wherein the top surface of the front section and the top surface of the rear section are aligned in substantially coplanar relation to form a platform and a platform-collapsing position wherein the top surface of the front section faces away from the rear leg and the top surface of the rear section faces away from the front leg. The front and rear legs cooperate with the multi-part platform so that the front and rear legs are in the opened position when the front and rear sections are in the platform-forming position and the front and rear legs are in the closed position when the front and rear sections are in the platform-collapsing position.

31 Claims, 6 Drawing Sheets

FIG. 1
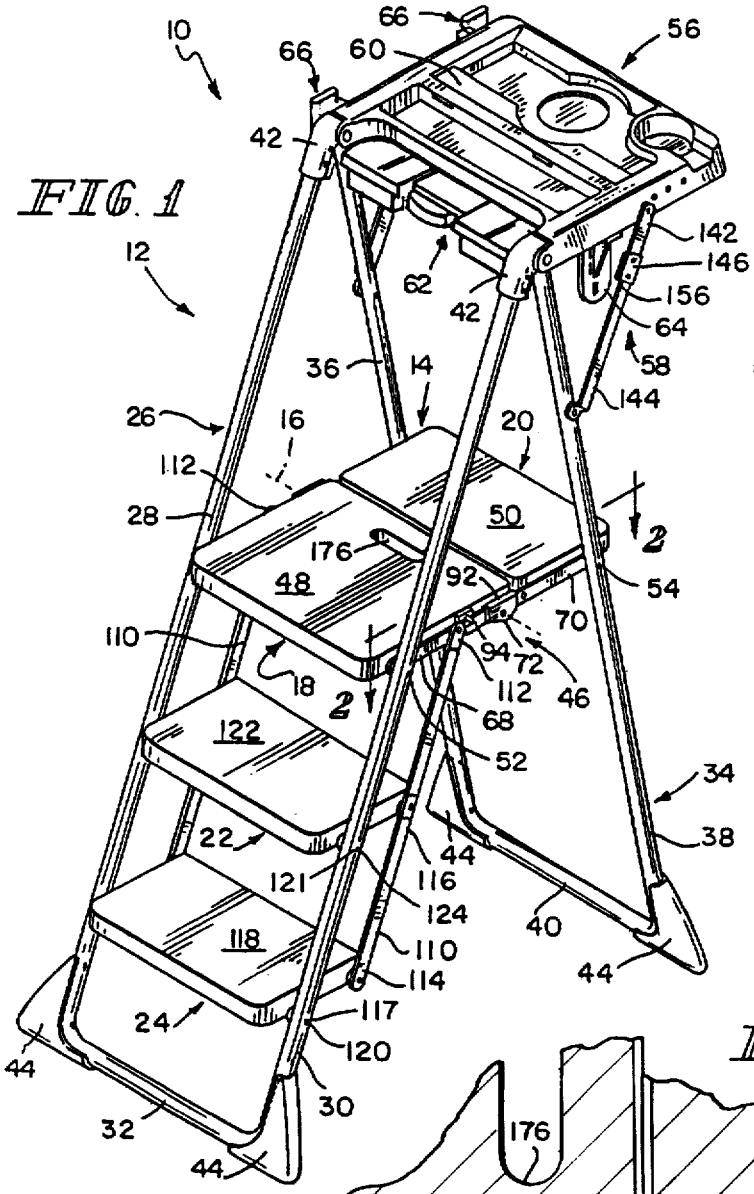
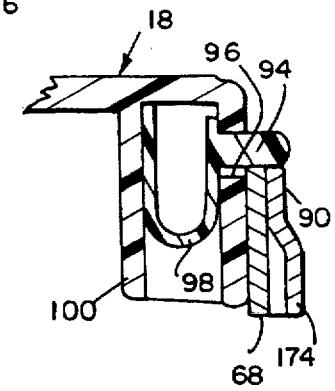
FIG. 3
FIG. 2
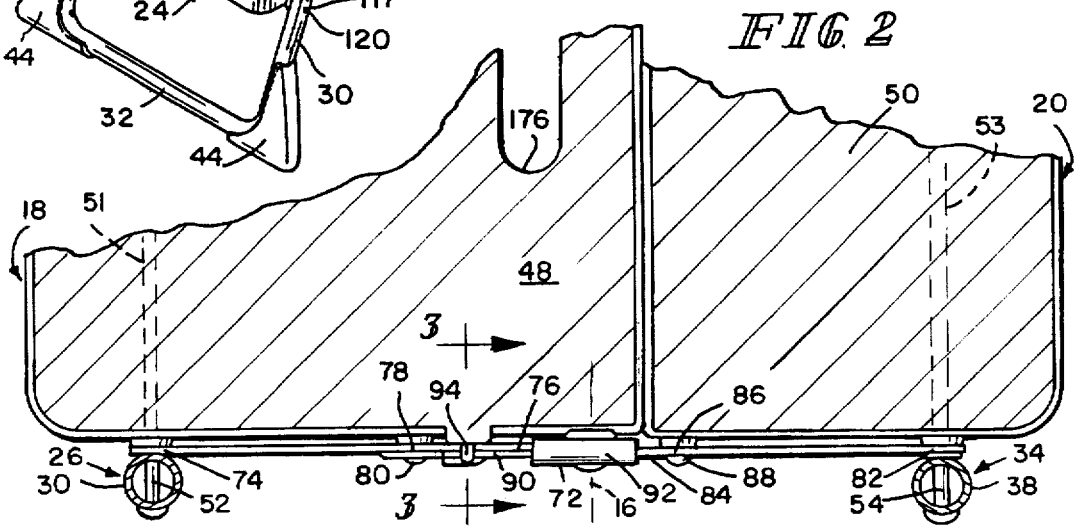

10
12
14
18
20
22
24
26
30
34
38
42
44
46
52
54
56
58
62
64
68
70
72
80
88
90
94
110
112
114
116
117
120
121
124
126
128
130
132
134
136
138
140
142
144
146
148
150
152
154
158
160

STEP STOOL ASSEMBLY

BACKGROUND AND SUMMARY OF THE INVENTION

The present invention relates to a step stool and particularly to a collapsible step stool that has a platform located above a plurality of steps. More particularly, the present invention relates to a step stool having a multi-part platform and having a linkage mechanism that allows sections of the multi-part platform to unfold from a collapsed position to automatically form a platform when the step stool is opened from a closed position. Additionally, the present invention relates to a step stool having a tray mounted to the frame and having a linkage mechanism that allows the tray to move between a storage position and a work position.

A step stool having a platform is known. See, for example, U.S. Pat. No. 4,485,892 to Maloney et al. The step stool disclosed in the Maloney '892 patent has a top step that is movable relative to a support frame from a raised position above an underlying lower step to a lowered position alongside the lower step. In its lowered position, the top step cooperates with the now-adjacent lower step to form a large elevated work platform on which a user may stand.

The TRI-STEP® Work Platform is a step stool available from Cosco, Inc. of Columbus, Ind. that is equipped with a tray providing a work surface on which a user can place objects. The tray is coupled to the frame to pivot between a storage position and a work position when the collapsible step stool is moved between a closed position and an opened position. The work surface of the tray is formed to include various recesses and apertures. Some of the recesses are configured to hold paint cans as well as tools and the apertures are provided with various diameters through which screwdrivers and other tools can be inserted to be supported by the tray.

According to the present invention, a step stool includes a frame having a front leg pivotably coupled at one end to a rear leg so that the legs can be moved between an opened position wherein a bottom end of the front leg is spaced apart from a bottom end of the rear leg and a closed position wherein the front and rear legs are adjacent to each other. The step stool has a multi-part platform that includes a front section pivotably coupled to the front leg, a rear section pivotably coupled to the rear leg, and means for pivotably coupling the front and rear sections together to fold about an axis. Each of the front and rear sections have a top surface and these top surfaces are aligned in substantially coplanar relation to form a platform when the step stool is fully opened. When the step stool is fully closed, the top surface of the front section faces away from the rear leg and the top surface of the rear section faces away from the front leg.

In preferred embodiments, the step stool has a collapsible frame including front and rear leg units each having a pair of legs. The front and rear legs are coupled together at free ends to pivot between an opened and a closed position. The bottom ends of the two front legs are interconnected by a cross member to form a U-shaped tube and similarly, the bottom ends of the two rear legs are interconnected by a cross member to form a U-shaped tube.

Above two ascending steps that are pivotably mounted to the front leg unit is the multi-part platform. This platform is pivotably mounted to the front and rear leg units. To allow the platform to unfold automatically into a platform-forming position when the step stool is opened, the front section of the multi-part platform is pivotably coupled to a rear section of the multi-part platform by a pair of platform support linkages attached to the multi-part platform and the front and rear leg units.

The step stool is also equipped with a tray that is pivotably coupled to the frame to pivot upwardly away from the frame from a storage position into a work position. The tray is supported in the work position by a pair of tray support linkages that can be used to collapse the tray independently of placement of the step stool in the opened and closed positions. The tray has a work surface formed to include tool-receiving apertures, paint can and beverage container recesses, paint tray attachment slots, a ruler, and drill bit size indicators. The tray is also provided with a drawer that is slidably mounted to the tray underneath the work surface. Mounted underneath the drawer is a pair of foldable paper towel holder flaps. The tray also has a pair of spaced-apart hooks mounted to a side of the tray upon which buckets can be hung and around which extension cords, ropes, and the like can be wrapped.

When the step stool is fully opened, the platform support linkages cooperate with the front and rear leg units to align top surfaces of the front and rear sections automatically in coplanar relation in the platform-forming position. The platform support linkages also support the front and rear sections in the platform-forming position so that a user can stand on the multi-part platform.

Additionally, to releasably lock the front and rear sections in the platform-forming position, the front section of the multi-part platform includes a single spring-biased latch pin that engages one of the platform support linkages. To close the step stool and collapse the platform, the latch pin can be manually pushed inwardly which disengages the latch pin from the platform support linkage thus allowing the front and rear sections to be folded into a platform-collapsing position.

To further aid in the collapse of the multi-part platform the step stool is provided with a hand-grip aperture formed in the front section. The hand-grip aperture is positioned near a rear edge of the front section which allows a user to pivot the front section relative to the front leg unit. When the step stool is opened from the closed position, the platform support linkage engages the latch pin and automatically plunges the latch pin inwardly so that the step stool can be opened without a user having to manually push the latch pin inwardly.

Independent of placement of the step stool in the opened and closed positions, the tray can be pivoted between the work and storage positions. The tray support linkages, which control movement of the tray between the work and storage positions, are connected from the tray to the rear leg unit and operate separately from the platform support linkages. Also, the tray support linkages releasably lock the tray in the work position.

What is provided is a collapsible step stool that, when opened, has two sections that unfold from a platform-collapsing position to align automatically in a platform-forming position to form a multi-part platform on which a user can stand. The step stool is also provided with a tray that is mounted to the frame of the step stool to pivot upwardly from a storage position to a work position. A tray support linkage controls movement of the tray between the work and storage positions separately from a platform support linkage that, as the step stool is opened and closed, controls movement of the multi-part platform between the platform-forming and platform-collapsing positions.

Additional objects, features, and advantages of the invention will become apparent to those skilled in the art upon consideration of the following detailed description of preferred embodiments exemplifying the best mode of carrying out the invention as presently perceived.

BRIEF DESCRIPTION OF THE DRAWINGS

The detailed description particularly refers to the accompanying figures in which:

FIG. 1 is a perspective view of a step stool in accordance with the present invention in an opened position showing a frame and front and rear sections of a multi-part platform coupled to the frame and positioned to lie in an unfolded platform-forming position and also showing a work tray supported by a separate tray support linkage in a raised work position;

FIG. 2 is a partial plan view of the multi-part platform taken along line 2—2 of FIG. 1 showing engagement of a latch pin that is mounted on one side of the front section of the multi-part platform and positioned to engage a platform support linkage coupled to the step stool frame;

FIG. 3 is an enlarged sectional view of a portion of the step stool taken generally along line 3—3 of FIG. 2 showing a latch pin and U-shaped spring abutting a support rib that extends downwardly from the front section of the multi-part platform and showing that the U-shaped spring biases the latch pin outwardly through an aperture formed in a side of the front section to extend over two links of the platform support linkage;

FIG. 6 is an enlarged sectional view of the latch pin, partly broken away, taken generally along line 3—3 of FIG. 2, showing a finger of a user depressing the latch pin to allow the multi-part platform to fold from the platform-forming position to a platform-collapsing position;

FIG. 7 is an enlarged side view of the platform support linkage showing the platform support linkage in an initial state of collapse as the finger of the user depresses the latch pin;

FIG. 8 is a view similar to FIG. 6 showing the latch pin being depressed inwardly by one link of the platform support linkage during folding movement of the platform support linkage;

FIG. 9 is a view similar to FIG. 7 showing one link of the support linkage positioned to depress the latch pin during folding movement of the platform support linkage;

FIG. 10 is a view similar to FIG. 8 showing further upward movement of a portion of one link of the platform support linkage during collapse of the multi-part platform;

FIG. 11 is a view similar to FIG. 10 showing upward movement of a portion of one link of the platform support linkage past the latch pin to allow the multi-part platform to be collapsed;

FIG. 14 is a view similar to FIG. 11 showing the cam flange formed in one link of the platform support linkage positioned above the latch pin during movement of the multi-part platform toward the platform-forming position;

FIG. 15 is a view similar to FIG. 14 showing the cam flange positioned to engage the latch pin to inwardly plunge the latch pin automatically during movement of the multi-part platform toward the platform-forming position;

FIG. 16 is a view similar to FIG. 15 showing the spring-biased latch pin engaging a portion of one link of the platform support linkage above the cam flange during movement of the multi-part platform toward the platform-forming position;

FIG. 17 is a view similar to FIG. 16 showing the position of the platform support linkage when the multi-part platform is in the platform-forming position;

DETAILED DESCRIPTION OF THE DRAWINGS

Figures 4, 5:
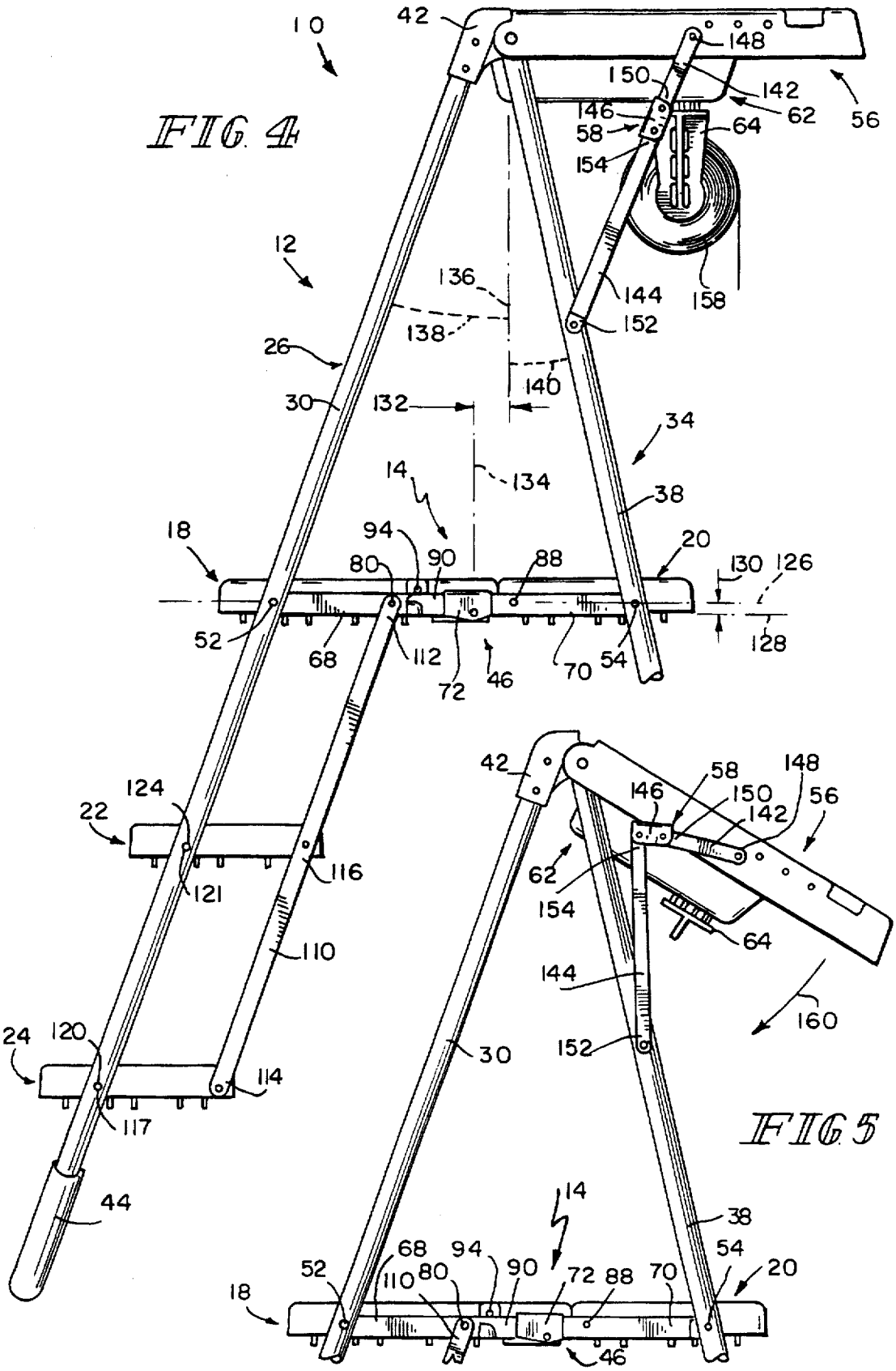
FIG. 4 is a partial side elevation view of the step stool of FIG. 1 in the opened position showing the front and rear sections supported in the platform-forming position by the platform support linkage and showing the tray supported in the work position by a separate tray support linkage.
FIG. 5 is a partial side elevation view of the step stool of FIG. 4 in the opened position showing the front and rear sections in the platform-forming position and also showing the tray in an intermediate position between the raised work position and a lowered storage position during folding movement of the tray toward rear legs of the step stool.

As shown in FIG. 1, a step stool 10 includes a frame 12, a multi-part platform 14 having a platform pivot axis 16 about which a front section 18 and a rear section 20 can fold and unfold, a second step 22, and a first step 24. The frame 12 includes a front leg unit 26 having two upwardly extending front legs 28, 30 and a cross member 32 therebetween and a rear leg unit 34 having two upwardly extending rear legs 36, 38 and a cross member 40 therebetween. Bottom portions of the two front legs 28,30 are integral with the cross member 32 in a U-shaped configuration and bottom portions of the two rear legs 36,38 are integral with the cross member 40 in a U-shaped configuration as shown in FIG. 1.

Figure 13:
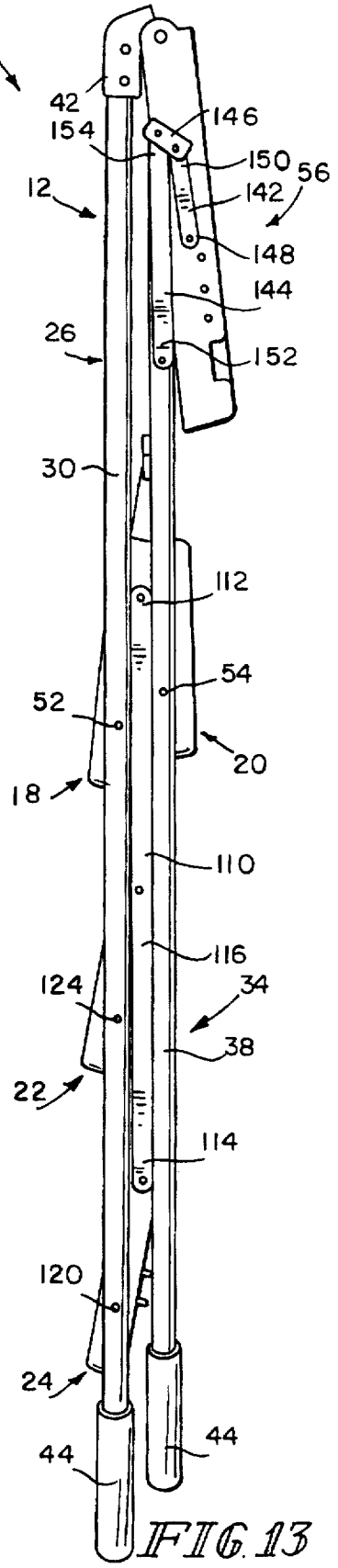
FIG. 13 is a side elevation view showing the step stool in the fully-closed position and showing the tray in the storage position.

The front legs 28,30 of the front leg unit 26 and the rear legs 36,38 of the rear leg unit 34 are pivotably coupled together by a pair of leg caps 42 that allow the front and rear leg units 26,34 to pivot between an opened position shown in FIG. 1 and a closed position shown in FIG. 13. In the opened position, the cross member 32 of the front leg unit 26 is spaced apart from the cross member 40 of the rear leg unit 34 as shown in FIG. 1. In the closed position shown in FIG. 14, the front leg unit 26 and the rear leg unit 34 are positioned to lie adjacent to one another. To provide added stability to the frame 12, a step stool support foot 44 is mounted at elbow portions of each of the front and rear leg units 26,34.

The multi-part platform 14 includes a pair of platform support linkages 46 which couple the front and rear sections 18,20 together for pivotal movement about the platform-pivot axis 16 between a platform-forming position shown in FIGS. 1, 2, 4, and 5, and a platform-collapsing position shown in FIG. 13. In the platform-forming position, a top surface 48 of the front section 18 and a top surface 50 of the rear section 20 are positioned to lie in substantially coplanar relation adjacent to one another. In the platform-collapsing position shown in FIG. 13, the top surface 48 of the front section 18 faces away from the rear legs 36,38 and the top surface 50 of the rear section 20 faces away from the front legs 28,30.

The front section 18 and each platform support linkage 46 are pivotably coupled to the front legs 28,30 of the front leg unit 26 by a first wire pivot rod 51, a portion of which provides a first pair of oppositely extending pivot pins 52. Likewise, the rear section 20 and each multi-part linkage 46 are pivotably coupled to the rear legs 36,38 of the rear leg unit 34 by a second wire pivot rod 53, a portion of which provides a second pair of oppositely extending pivot pins 54. In this arrangement, the pair of platform support linkages 46 act to pivot the front and rear sections 18,20 automatically about the platform pivot axis 16 between the platform-forming position and the platform-collapsing position as the front and rear leg units 26,34 are manually moved between the opened and closed positions.

Figure 12:
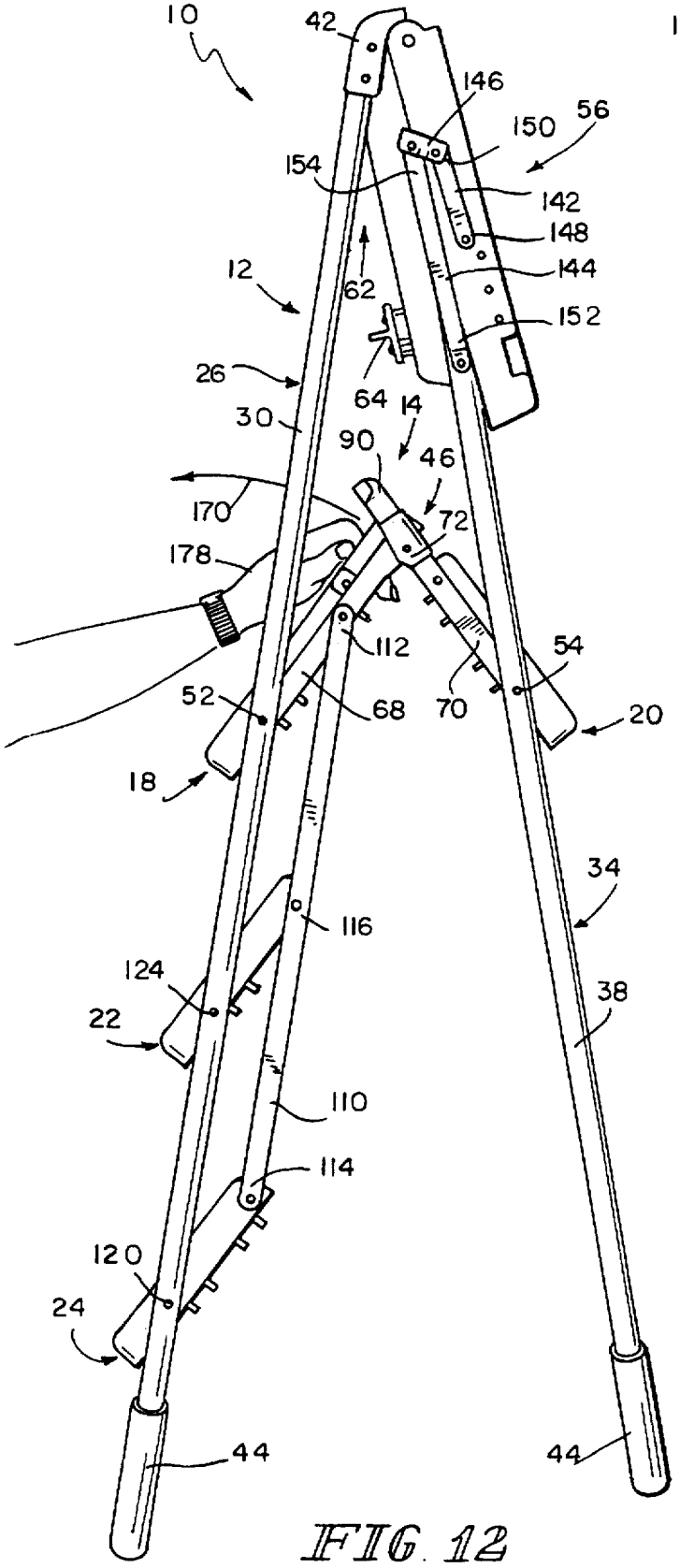
FIG. 12 is a side elevation view showing the step stool in an intermediate position and showing the tray in the storage position.
Figure 18:
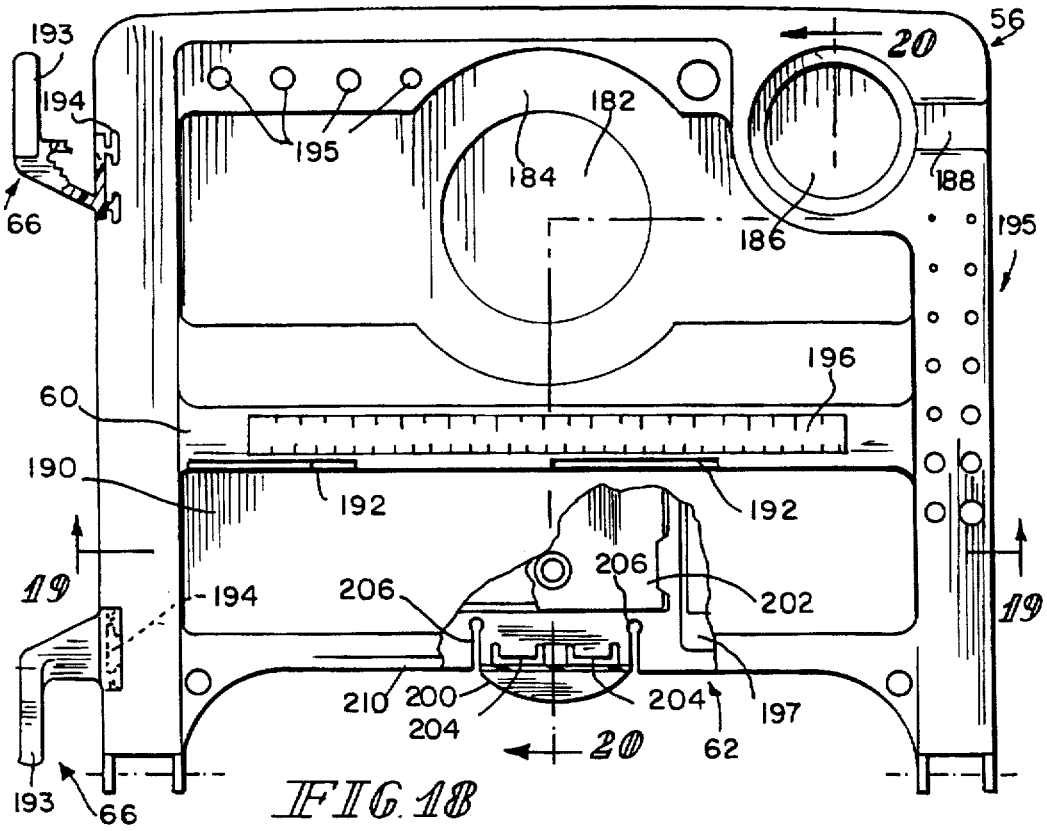
FIG. 18 is a top plan view of the tray, with portions broken away, showing a work surface that includes paint can and beverage container recesses, tool support and drill bit size indicator apertures, a built-in ruler, a drawer handle of a drawer mounted to the tray underneath the work surface, and a pair of spaced-apart hooks mounted to the left side of the tray in hook-receiving slots formed in the tray.
Figure 19:
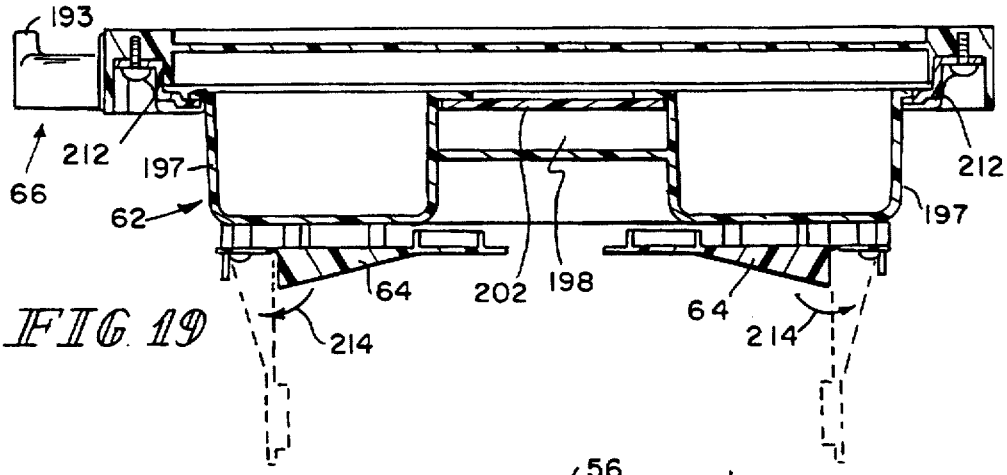
FIG. 19 is a sectional view of the tray taken along line 19—19 of FIG. 18 showing the drawer with two side compartments separated by a middle compartment covered by a retainer plate and showing a paper towel holder flap mounted underneath each side compartment (solid lines) and supported for pivotable movement to a towel holder position (phantom lines)

The step stool 10 includes a tray 56 that is pivotably coupled to the pair of leg caps 42. As shown in FIGS. 1 and 4, a pair of tray support linkages 58 support the tray 56 in a raised work position wherein a work surface 60 of the tray is horizontally deployed. The tray support linkages 58 are foldable independently of the platform support linkages 46 as illustrated in FIG. 5. As shown in FIGS. 12 and 13, the tray 56 can be placed in a storage position wherein the tray 56 is folded downwardly to lie flat against the rear leg unit 34. A drawer 62 is mounted to the tray 56 underneath the work surface 60. FIG. 1 shows the drawer 62 in a partially-opened position. A pair of paper towel holder flaps 64 are mounted to the drawer 62 underneath the drawer, as shown in FIGS. 1 and 4, and a pair of spaced-apart hooks 66 are mounted to the tray as shown in FIGS. 1, 18, and 19.

As shown in FIGS. 1, 2, and 4, each platform support linkage 46 includes a front link 68, a rear link 70, and a link bracket 72 all of which can be fabricated from a lightweight metal material. As illustrated in FIG. 2, each front link 68 has a first end 74 pivotably coupled to the front leg unit 26 to pivot about one of the first pair of pivot pins 52, a second end 76 pivotably coupled to one of the pair of the link brackets 72, and a middle portion 78 pinned to the front section 18 by one of a pair of first coupling pins 80 so that each front link 68 moves simultaneously with movement of the front section 18. Each rear link 70 has a first end 82 pivotably coupled to the rear leg unit 34 to pivot about one of the second pair of pivot pins 54, a first middle portion 84 pivotably coupled to one of the pair of link brackets 72, and a second middle portion 86 pinned to the rear section 20 by one of a pair of second coupling pins 88 so that each rear link 70 moves simultaneously with movement of the rear section 20.

As best shown in FIGS. 1 and 2, the second end 76 of each front link 68 and the first middle portion 84 of each rear link 70 are both coupled to respective link bracket 72 to pivot about platform pivot axis 16. Because the front links 68 and the front section 18 are coupled to move together by the first coupling pins 80 and the rear links 70 and rear section 20 are coupled to move together by the second coupling pins 88, the front section 18 and the rear section 20 also pivot about platform pivot axis 16. As step stool 10 is moved from an opened position shown in FIGS. 1 and 4, through an intermediate position shown in FIG. 12, to a fully-closed position shown in FIG. 13, each link bracket 72 moves upwardly toward each leg cap 42.

As shown in FIGS. 1, 2, 4, and 12, each rear link 70 has a free end 90 which extends past the respective link bracket 72. Each link bracket 72 has a top plate 92 which includes an inner surface 93 that engages the rear links 70 to cause each link bracket 72 to remain in the same orientation relative to the respective rear link 70 as the rear link 70 is pivoted. When the front and rear sections 18,20 are in the platform-forming position shown in FIGS. 1, 4, and 5, the inner surface 93 of each top plate 92 engages a portion of the respective front and rear links 68,70 to prevent the front and rear links 68,70 from pivoting downwardly past a generally in-line orientation. Thus, the link bracket 72 supports the front and rear sections 18,20 in the platform-forming position.

In addition, step stool 10 includes a latch pin 94 that projects laterally outwardly through an aperture 96 formed in the front section 18 and extends over the free end 90 of the rear link 70 to releasably lock the front and rear sections 18,20 in the platform-forming position as shown in FIGS. 2 and 3. FIG. 3 illustrates that the latch pin 94 is urged outwardly through the aperture 96 by a U-shaped spring 98 which is integral with the latch pin 94 and which abuts against a support rib 100 that extends downwardly from the front section 18.

A pair of step links 110 are provided for supporting the first and second steps 24,22 on frame 12 when the step stool 10 is placed in the opened position as shown in FIGS. 1 and 4. The step link 110 is pivotably coupled at a top end 112 to the first coupling pin 80 at the middle portion 78 of the front link 68 and is pivotably coupled at a bottom end 114 to the first step 24. Between the top end 112 and the bottom end 114, the step link 110 has a middle portion 116 pivotably coupled to the second step 22.

The first step 24 is journaled to the front leg unit 26 by a third wire pivot rod 117 attached along the length of the first step 24 underneath a top surface 118 of the first step 24 to provide a third pair of oppositely extending pivot pins 120 about which the first step 24 can pivot. Likewise, the second step 22 is journaled to the front leg unit 26 by a fourth wire pivot rod 121 attached along the length of the second step 22 underneath a top surface 122 of the second step 22 to provide a fourth pair of oppositely extending pivot pins 124 about which the second step 22 can pivot. In this arrangement, each step link 110, each front link 68, the front leg unit 26, and the steps 22,24 cooperate to maintain the top surface 118 of the first step 24, the top surface 122 of the second step 22, and the top surface 48 of the front section 18 in parallel relation to one another as the step stool 10 is moved between the opened and closed positions.

The front and rear sections 18,20 are supported adjacent to one another to form a large platform surface 48, 50 on which a user can stand when the front and rear sections are moved to the opened position shown in FIGS. 1 and 4. As shown in FIG. 4, the platform pivot axis 16 lies below a line 126 (phantom line) that connects the first pair of pivot pins 52 with the second pair of pivot pins 54 when the front and rear sections 18,20 are in the platform-forming position. A line 128 (phantom line) that passes through the platform pivot axis 16 and is parallel to line 126 is also shown in FIG. 4. A distance 130 separates line 126 from line 128. The front edge of rear section 20 and the rear edge of front section 18 are positioned to lie in confronting separated relation to define a vertical space therebetween when front and rear sections 18, 20 are in the platform-forming position. This vertical space is laterally offset from platform pivot axis 16 about which first and second sections 18, 20 pivot as shown in FIGS. 1 and 2.

The position of the leg caps 42 and the tray 56 allow a user (not shown) to have increased standing room on the multi-part platform 14. As shown in FIG. 4, a distance 132 is formed when the front and rear sections 18,20 are placed in the platform-forming position between a line 134 (phantom line) extending vertically upwardly from the platform pivot axis 16 and a line 136 (phantom line) extending vertically downwardly from where the rear leg unit 34 pivotably connects to the leg caps 42. Because the rear legs 36,38 of the rear leg unit 34 are shorter than the front legs 28,30 of the front leg unit 26, an angle 138 (phantom arc) between line 136 and the front leg unit 26 is larger than an angle 140 (phantom arc) between line 136 and the rear leg unit 34. Due to this geometry, the portion of the multi-part platform 14 that the tray 56 overhangs when the step stool 10 is in the fully-opened position is decreased which results in an increased amount of standing room available on the multi-part platform 14.

As shown in FIGS. 1 and 4, each tray support linkage 58 is mounted to the rear leg unit 34 and the tray 56. The tray support linkage 58 controls movement of the tray 56 between the work position shown in FIGS. 1 and 4, and the storage position shown in FIGS. 12 and 13. Each tray support linkage 58 includes a first support link 142, a second support link 144, and a support link bracket 146. The first support link 142 is pivotably coupled at a first end 148 to the tray 56 and is pivotably coupled at a second end 150 to the support link bracket 146. The second support link 144 is pivotably coupled at a first end 152 to the rear leg unit 34 between the leg cap 42 and the rear section 20 and is pivotably coupled at a second end 154 to the support link bracket 146.

As best shown in FIG. 4, when the tray 56 is placed in the work position, the first support link 142 and the second support link 144 have a generally in-line orientation. The support link bracket 146 includes a top plate 156 that engages a portion of the first support link 142 and a portion of the second support link 144 to prevent the first and second support links 142,144 from pivoting past the generally in-line orientation shown in FIG. 4. The engagement of the top plate 156 of the support link bracket 146 with the first and second support links 142,144 supports and releasably locks the tray 56 in the work position. FIG. 4 also shows a paper towel roll 158 supported by the paper towel holder flaps 64.

In FIG. 5, step stool 10 is shown with the paper towel roll 158 removed and the paper towel holder flaps 64 folded upwardly and inwardly to store underneath the drawer 62. As also shown in FIG. 5, the tray 56 is in an intermediate position between the work position and the storage position and the tray support linkage 58 is in a partially-folded position. An arrow 160 indicates the direction that the tray 56 pivots to reach the storage position from the intermediate position. The tray support linkage 58 can fold separately from the platform support linkage 46 that supports the multi-part platform 14 and hence, the tray 56 can be moved between the work position and the storage position independently of placement of the step stool 10 in the opened position and the closed position. When the tray 56 is in the storage position shown in FIGS. 12 and 13, the first support link 142 and the second support link 144 are in a folded orientation to lie adjacent to one another and the support link bracket 146 is adjacent to the tray 56 above the first end 148 of the first support link 142 and above the first end 152 of the second support link 144.

Figure 6:
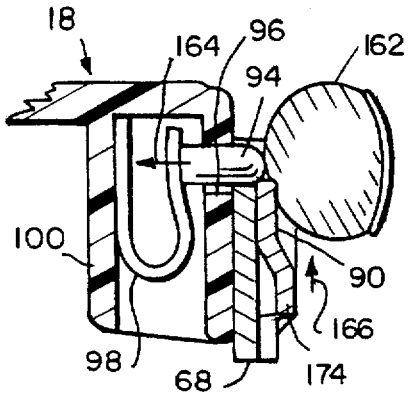
FIGS. 6–11 show a manual operation sequence of the spring-biased latch pin being disengaged from the platform support linkage to allow the front and rear sections to be moved out of the platform-forming position so that the step stool can be folded from its opened position to its closed position.
Figure 7:
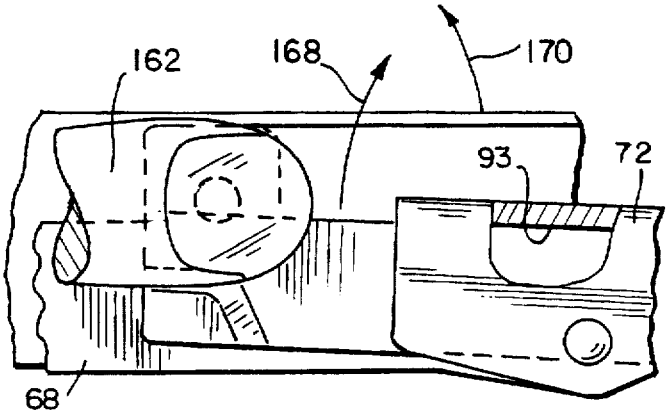

In use, to close the step stool 10 from the opened position shown in FIGS. 1, 4, and 5, the latch pin 94 must first be pushed manually inwardly so that the free end 90 of the rear link 70 can pivot upwardly past the latch pin 94. As shown in FIG. 6, a finger 162 of a user (not shown) can be used to partially depress the latch pin 94 in the direction of arrow 164 so that the free end 90 of the rear link 70 can move in an upward direction indicated by arrow 166. A side view of the finger 162 of the user (not shown) depressing the latch pin 94 is shown in FIG. 7. When the latch pin 94 is pushed inwardly, the rear link 70 and rear section 20 can pivot in the direction indicated by arrow 168 and the front link 68 and front section 18 can pivot in the direction indicated by arrow 170 shown in FIG. 7.

Figure 8:
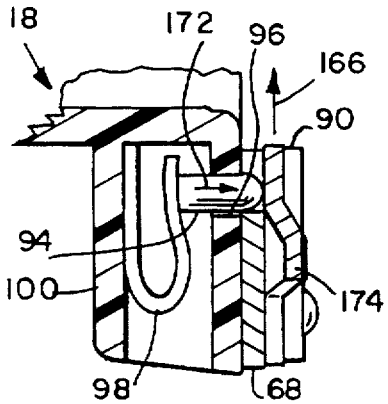
Figure 9:
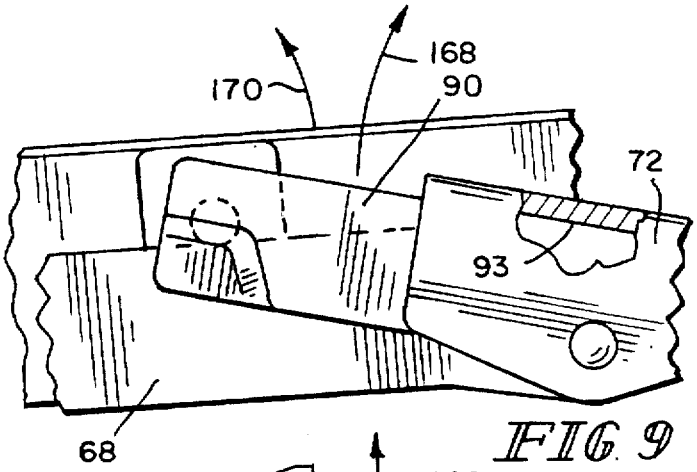

After the latch pin 94 has been inwardly depressed far enough, the free end 90 of the rear link 70 can move further upwardly in the direction of arrow 166 as shown in FIG. 8, the front section can further pivot in the direction indicated by arrow 170, and the rear section can further pivot in the direction indicated by arrow 168 as shown in FIG. 9. When the free end 90 of the rear link 70 is in the position shown in FIGS. 8 and 9, the user (not shown) no longer needs to depress the latch pin 94 which is biased outwardly in the direction indicated by arrow 172 into contact with the free end 90 of the rear link. Due to the top plate 92 of the link bracket 72, the link bracket 72 and the rear link 70 are kept in a consistent orientation relative to one another as the rear section 20 is pivoted in the direction indicated by arrow 168 shown in FIG. 9.

Figure 10:
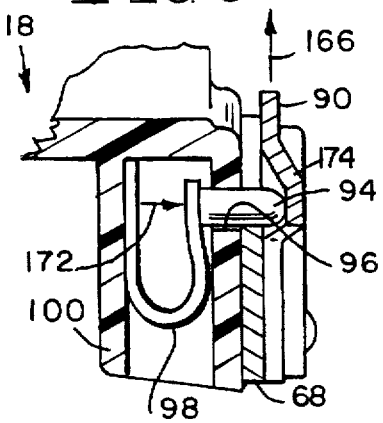
Figure 11:
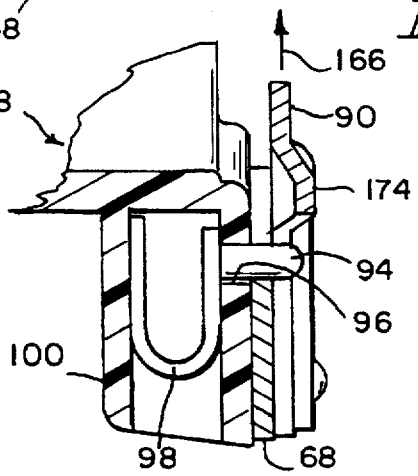

When the free end 90 of the rear link 70 is moved upwardly in the direction indicated by arrow 166 slightly past the position shown in FIGS. 8 and 9 into the position shown in FIG. 10, the U-shaped spring 98 urges the latch pin 94 into contact with a cam flange 174 formed in the free end 90 of the rear link 70. When the cam flange 174 formed in the free end 90 of the rear link 70 is pivoted out of contact with the latch pin 94, the U-shaped spring 98 urges the latch pin 94 outwardly to the position illustrated in FIG. 11. Further pivoting of the front section in the direction of arrow 170 and further pivoting of the rear section in the direction of arrow 168 moves the step stool 10 to an intermediate position between the opened position and the closed. position as shown in FIG. 12. As also shown in FIG. 12, the tray 56 is in the storage position.

In the preferred embodiment, a hand-grip aperture 176 is formed in the front section 18. As shown in FIGS. 1 and 2, the top surface 48 of the front section 18 is larger than the top surface 50 of the rear section 20 and the hand-grip aperture 176 is located in a rear portion of the front section 18. A user (not shown) can engage the hand-grip aperture 176 with one hand 178, as shown in FIG. 12, and can pivot the front section 18 about the first pair of pivot pins 52 in the direction of arrow 170 to move the front and rear sections 18,20 of the multi-part platform 14 from the platform-forming position to the platform-collapsing position thus moving the step stool 10 from the opened position to the closed position.

As illustrated in FIG. 13, the step stool 10 is in the fully closed position and the tray 56 is in the storage position. In this arrangement, each step link 110 is substantially parallel to the front legs 28,30 of the front leg unit 26 and the rear legs 36,38 of the rear leg unit 34. The top surface 118 of the first step 24, the top surface 122 of the second step 22, and the top surface 48 of the front section 18 all face away from the rear leg unit 34 when the step stool 10 is in the fully-closed position. In contrast, the work surface 60 of the tray 56 and the top surface 50 of the rear section 20 face away from the front leg unit 26 when the step stool 10 is in the fully-closed position.

Figure 14:
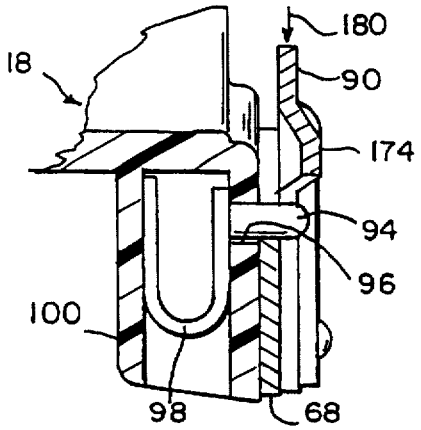
FIGS. 14–17 show use of a cam flange formed in one link of the platform support linkage to plunge the spring-biased latch pin automatically to allow the multi-part platform to be placed in the platform-forming position during unfolding of the step stool from its closed position to its opened position.
Figure 15:
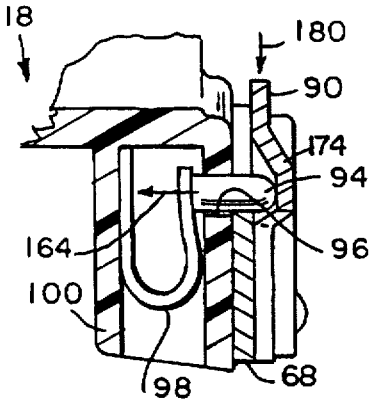
Figure 16:
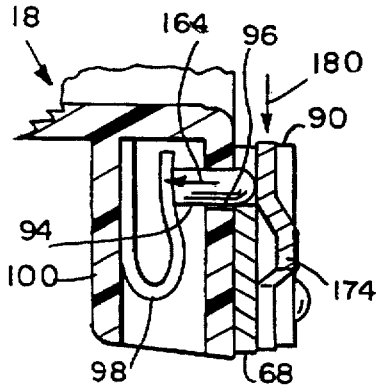
Figure 17:
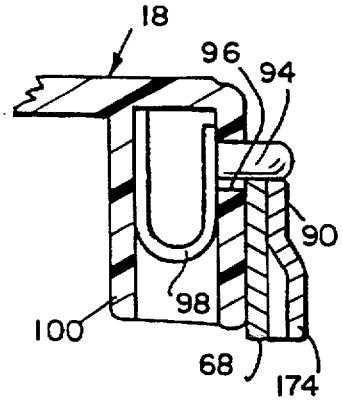

The cam flange 174 formed in the free end 90 of the rear link 70 automatically plunges the latch pin 94 inwardly during movement of the step stool 10 from the closed position to the opened position. As shown in FIG. 14, the cam flange 174 is in a position just above the latch pin 94 as the free end 90 of the rear link 70 is moved downwardly in a direction indicated by arrow 180. As shown in FIG. 15, when the free end 90 of the rear link 70 is moved further in the direction indicated by arrow 180, the cam flange 174 contacts the latch pin 94 and plunges the latch pin 94 inwardly in the direction indicated by arrow 164. The latch pin 94 is plunged further inwardly in the direction indicated by arrow 164 when the free end 90 of the rear link 70 is further moved in the direction indicated by arrow 180 and placed in the position shown in FIG. 16. When the free end 90 of the rear link 70 reaches the position shown in FIG. 17, the U-shaped spring 98 biases the latch pin 94 outwardly to extend over the rear link 70 to releasably lock the front and rear sections 18,20 in the platform-forming position.

The work surface 60 of the tray 56 is illustrated in FIG. 18. The work surface 60 includes a small paint can recess 182, a large paint can recess 184 a portion of which is concentric with the small paint can recess 182, and a beverage container recess 186 that includes a mug handle recess 188. An elongated recess 190 is also formed in the tray 56 and a pair of spaced-apart roller paint pan tab receiving slots 192 are formed in a portion of the elongated recess 190.

As shown in FIGS. 18 and 19, the pair of spaced-apart hooks 66 each have a raised bump 193 to allow a bucket (not shown) to be hooked onto the tray 56 by its wire handle (not shown). Other objects (not shown) such as a trouble light (not shown) can also be hooked onto the tray 56 in a similar fashion. The pair of spaced-apart hooks 66 are mounted to the tray 56 in hook-receiving slots 194 formed in the tray 56.

The work surface 60 of the tray 56 is also formed to include a plurality of apertures 195 through which screwdrivers (not shown) or other tools (not shown) can be inserted to be supported by the tray. Drill bit size indicators (not shown) can be molded into the work surface 60 of the tray next to each of the plurality of apertures 195. A ruler 196 also can be molded into the work surface 60 of the tray 56 as shown in FIG. 18.

Figure 20:
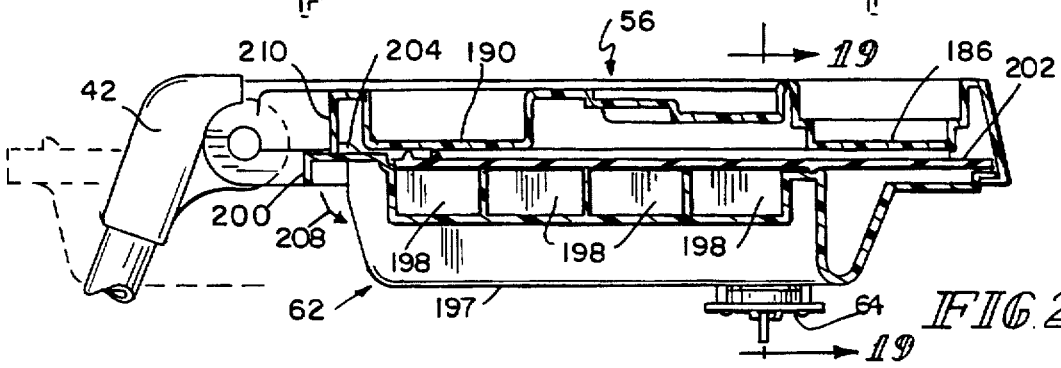
FIG. 20 is a sectional view of the tray taken along line 20—20 of FIG. 18 showing movement of the drawer to the left to an opened position (phantom lines).

The drawer 62 is formed to include two side compartments 197 separated by four adjacent middle compartments 198 as shown in FIGS. 19 and 20. A drawer handle 200 is provided for opening and closing the drawer 62 and a drawer retainer cap 202 is slidably mounted to the drawer 62 above the four middle compartments 198. When the drawer retainer cap 202 is closed to cover the four middle compartments 198, objects (not shown) stored in the four middle compartments 198 are prevented from falling out of the drawer 62.

A pair of raised drawer latches 204 are molded into the drawer 62 next to the drawer handle 200 as shown in FIG. 18. A relief slot 206 is formed in the drawer on each side of the pair of drawer latches 204 as also shown in FIG. 18. The relief slots 206 permit the drawer handle 200 to be elastically pressed downwardly in the direction indicated by arrow 208 shown in FIG. 20 so that the pair of drawer latches 204 disengage from a front edge 210 of the tray 56 to allow the drawer 62 to be moved from a closed position (solid lines of FIG. 20) to an opened position (broken lines of FIG. 20). The drawer latches 204 are formed to cam against the front edge 210 of the tray 56 when the drawer 62 is closed, thus causing the drawer handle 200 to be pressed downwardly in the direction of arrow 208. When the drawer 62 is fully closed, the drawer latches 204 engage the front edge 210 as shown in FIG. 20 to prevent the drawer from opening.

The drawer 62 is mounted to the tray by two guide rails 212 which are bolted to the tray 56. The drawer 62 has portions that extend between the guide rails 212 and the tray 56 as shown in FIG. 19 and the portions of the drawer 62 between the guide rails 212 and the tray 56 support the drawer 62 for sliding movement between the opened and closed positions.

One of the pair of paper towel holder flaps 64 is mounted to the drawer 62 underneath each side compartment 156 as shown in FIG. 19. In the preferred embodiment of the step stool, the paper towel holder flaps 64 are capable of being pivoted from a folded storage position (solid lines) to a towel holder position (broken lines) in the direction indicated by arrows 214 shown in FIG. 19.

Although the invention has been described in detail with reference to certain preferred embodiments and specific examples, variations and modifications exist within the scope and spirit of the invention as described and as defined in the following claims.

I claim:

1. A platform stool comprising a frame including a from leg and a rear leg, the front leg being pivotably coupled to the rear leg for movement about a leg pivot axis between an opened position wherein a bottom portion of the front leg is spaced-apart from a bottom portion of the rear leg and a closed position wherein the from leg is adjacent to the rear leg, and a multi-part platform including a front section pivotably coupled to the front leg, a rear section pivotably coupled to the rear leg, each of the front and rear sections having a top surface, and a platform support linkage coupling the front section to the rear section for movement about a platform pivot axis between a platform-forming position wherein the top surface of the front section and the top surface of the rear section are aligned in substantially coplanar relation to form a platform and a platform-collapsing position wherein the top surface of the front section faces away from the rear leg and the top surface of the rear section faces away from the front leg, the front and rear legs cooperating with the multi-part platform so that the front and rear legs are in the opened position when the front and rear sections are in the platform-forming position and the front and rear legs are in the closed position when the front and rear sections are in the platform-collapsing position, the front section including a rear edge, the rear section including a front edge, the front edge being arranged in confronting separated relation with the rear edge when the multi-part platform is in the platform-forming position so as to define a vertical space therebetween, the platform pivot axis being laterally offset from the vertical space.

2. The platform stool of claim 1, wherein the platform support linkage includes a front link connected to the front section, the platform support linkage includes a rear link connected to the rear section, and the front link is pivotably coupled to the rear link at the platform pivot axis.

3. The platform stool of claim 2, wherein the front link is pivotably coupled to the front leg and the rear link is pivotably coupled to the rear leg.

4. The platform stool of claim 3, wherein a portion of the front link is positioned to lie between the front section and the front leg, the front link and the front section pivot relative to the front leg at a common pivot point, a portion of the rear link is positioned to lie between the rear section and the rear leg, and the rear link and the rear section pivot relative to the rear leg at a common pivot point.

5. The platform stool of claim 3, wherein the platform support linkage includes a link bracket coupled to the front and rear links at the platform pivot axis, and the link bracket includes a surface that engages the front and rear links to support the front and rear sections in the platform-forming position.

6. The platform stool of claim 3, wherein the front link has a middle portion pinned to the front section so that the front link moves simultaneously with movement of the front section and the rear link has a middle portion pinned to the rear section so that the rear link moves simultaneously with movement of the rear section.

7. The platform stool of claim 6, further comprising a step pivotably coupled to the front leg below the front section and a step link pivotably coupled at a first point to the step and pivotably coupled at a second point to the middle portion of the front platform link, each of the step and front section having top surfaces, and the front leg, the step, the step link, and the front section forming a parallelogram linkage that supports the top surface of the step in parallel relation to the top surface of the front section during movement of the platform stool between the opened position and the closed position.

8. The platform stool of claim 1, wherein a portion of the top surface of the front section extends over the platform pivot axis when the multi-part platform is in the platform-forming position.

9. The platform stool of claim 1, further comprising a tray having a work surface, a side, and an outer edge, the tray being coupled to the frame for pivoting movement about the leg pivot axis between a work position wherein the outer edge of the tray is spaced apart from the frame and a storage position wherein a portion of the outer edge is adjacent to the frame, the tray being pivotable between the work position and the storage position independently of placement of the platform stool in the opened position and the closed position.

10. The platform stool of claim 9, wherein the tray is supported in the work position by a support linkage and the support linkage has a top end pivotably coupled to the tray and a bottom end pivotably coupled to the rear leg between the leg pivot axis and the rear section of the multi-part platform.

11. The platform stool of claim 10, wherein the support linkage has a first support link that includes the top end of the support linkage and a second support link that includes the bottom end of the support linkage, the first support link is pivotably coupled to the second support link for movement between a support position wherein the first support link and the second support link are aligned in substantially end-to-end relation to releasably lock and support the tray in the work position and a folded position wherein the first support link and the second support link are adjacent to the side of the tray and are in angled relation to define an acute angle, the second support link is substantially parallel with the front leg when the second support link is in the support position, and the second support link is substantially parallel with the rear leg when the second support link is in the folded position.

12. The platform stool of claim 1, wherein the platform support linkage includes a front link coupled to the front section, a rear link coupled to the rear section, and a link bracket coupled to the front and rear links at the platform pivot axis, and the link bracket is laterally offset from the vertical space.

13. The platform stool of claim 1, wherein the platform support linkage includes a front link coupled to the from section, a rear link coupled to the rear section, and a link bracket coupled to the from and rear links at the platform pivot axis, the front link includes a top edge, the rear link includes a top edge, and the link bracket includes a top plate that engages the top edges of the front and rear links to support the front and rear sections in the platform-forming position.

14. The platform stool of claim 1, wherein the platform support linkage includes a front link coupled to the front section and a rear link coupled to the rear section, the front link is coupled to the rear link at the platform pivot axis, the multi-part platform includes a latch pin coupled to the front section, and the latch pin is positioned for movement to an extended position projecting over a portion of the rear link to lock the multi-part platform in the platform-forming position.

15. The platform stool of claim 1, wherein the platform support linkage includes a front link coupled to the front section and a rear link coupled to the rear section, the front link is pivotably coupled to the rear link at the platform pivot axis, the rear link has a free end, the multi-part platform includes a latch pin coupled to the front section and positioned for movement between an extended position wherein the latch pin projects over the free end of the rear link to lock the front and rear sections in the platform-forming position and a retracted position wherein the free end of the rear link can pivot past the latch pin allowing the front and rear sections to be moved from the platform-forming position to the platform collapsing position.

16. The platform stool of claim 15, wherein the free end of the rear link includes a cam surface that engages the latch pin to plunge the latch pin from the extended position to the retracted position during movement of the front and rear sections from the platform-collapsing position to the platform-forming position.

17. The platform stool of claim 15, wherein the front section includes a side wall having an aperture therein and the latch pin extends through the aperture.

18. The platform stool of claim 17, wherein the front section includes a support rib spaced apart from the side wall of the front section and further comprising a spring coupled to the latch pin and engaging the support rib to bias the latch pin through the aperture into the extended position.

19. A platform stool comprising a frame including a front leg and a rear leg, the front leg being pivotably coupled to the rear leg for movement about a leg pivot axis between an opened position wherein a bottom portion of the front leg is spaced-apart from a bottom portion of the rear leg and a closed position wherein the front leg is adjacent to the rear leg, a multi-pan platform including a front section pivotably coupled to the front leg, a rear section pivotably coupled to the rear leg, each of the front and rear sections having a top surface, and a coupling pivotably coupling the front section to the rear section for movement between a platform-forming position wherein the top surface of the front section and the top surface of the rear section are aligned in substantially coplanar relation to form a platform and a platform-collapsing position wherein the top surface of the front section faces away from the rear leg and the top surface or the rear section faces away from the front leg, the front and rear legs cooperating with the front and rear sections so that the front and rear legs are in the opened position when the front and rear sections are in the platform-forming position and the front and rear legs are in the closed position when the front and rear sections are in the platform-collapsing position, the coupling includes a front link connected to the front section, a rear link connected to the rear section, and the front link is pivotably coupled to the rear link at a link pivot point, the rear link having a free end that extends from the link pivot point toward the front leg and overlaps a portion of the front link when the front and rear sections are in the platform-forming position, and a latch pin slidably coupled to the front section to move between an extended position wherein the latch pin projects over the free end of the rear link when the front and rear sections are in the platform-forming position to lock the front and rear sections in the platform-forming position and a retracted position wherein the free end of the rear link can pivot past the latch pin allowing the front and rear sections to be moved from the platform-forming position to the platform collapsing position.

20. The platform stool of claim 7, further comprising a spring coupled to the latch pin and engaging the front section to bias the latch pin into the extended position and the free end of the rear link includes a cam surface that engages the latch pin during movement of the front and rear sections from the platform-collapsing position to the platform-forming position to plunge the latch pin from the extended position to the retracted position until the front and rear sections fully reach the platform-forming position where the spring urges the latch pin into the extended position.

21. A platform stool comprising a frame including a front leg and a rear leg, the from leg being pivotably coupled to the rear leg for movement about a leg pivot axis between an opened position wherein a bottom portion of the front leg is spaced apart from a bottom portion of the rear leg and a closed position wherein the front leg is adjacent to the rear leg, a multi-part platform including a front section pivotably coupled to the front leg to pivot about a front pivot axis and a rear section pivotably coupled to the rear leg to pivot about a rear pivot axis, the front section being pivotably coupled to the rear section to pivot about a platform pivot axis that is vertically movable between a platform-forming position wherein the front pivot axis and the rear pivot axis define a plane therebetween and the platform pivot axis is located a first vertical distance away from the leg pivot axis below the plane and a platform-collapsing position wherein the front pivot axis and rear pivot axis are adjacent to one another and the platform pivot axis is located a second vertical distance away from the leg pivot axis, the front and rear legs cooperating with the front and rear sections so that the front and rear legs are in the opened position when the front and rear sections are in the platform-forming position and the front and rear legs are in the closed position when the front and rear sections are in the platform-collapsing position, the front section being pivotably coupled to the rear section by a platform linkage, the platform linkage including a front link and a rear link, the front link being pivotably coupled to the front leg to pivot about the front pivot axis and having a middle point pinned to the front section so that the front link moves simultaneously with front section movement, the rear link being pivotably coupled to the rear leg to pivot about the rear pivot axis and having a middle point pinned to the rear section so that the rear link moves simultaneously with rear section movement, the front link being pivotably coupled to the rear link to pivot about the platform pivot axis, the rear link having a free end that extends from the link pivot point toward the front leg and overlaps a portion of the front link when the front and rear sections are in the platform-forming position, a latch pin slidably coupled to the front section to move between an extended position wherein the latch pin projects over the free end of the rear link when the front and rear sections are in the platform-forming position to lock the front and rear sections in the platform-forming position and a retracted position wherein the free end of the rear link can pivot past the latch pin allowing the front and rear sections to be moved from the platform-forming position to the platform collapsing position, and a spring that urges the latch pin into the extended position, the free end of the rear link including a cam surface that engages the latch pin during movement of the front and rear sections from the platform-collapsing position to the platform-forming position to plunge the latch pin from the extended position to the retracted position until the front and rear sections fully reach the platform-forming position where the spring urges the latch pin into the extended position.

22. A platform stool comprising a frame including a front leg and a rear leg, the front leg being pivotably coupled to the rear leg at a leg pivot axis for pivoting movement, a step mounted to the frame, a tray having an outer edge and a side, the tray being coupled to the frame above the step at the leg pivot axis for pivoting movement between a work position wherein the outer edge of the tray is spaced apart from the frame and a storage position wherein a portion of the outer edge is adjacent to the frame, and a support linkage supporting the tray in the work position, the support linkage having a bottom end coupled to the frame and a top end coupled to the tray.

23. The platform stool of claim 22, wherein the top end of the support linkage is coupled to the tray at a link pivot point that is horizontally aligned with the leg pivot axis when the tray is in the work position.

24. The platform stool of claim 22, wherein the support linkage includes a first link coupled to the tray at a first link pivot point, a second link coupled to the rear leg at a second link pivot point, and a bracket coupling the first link to the second link, and the support linkage is movable between a support position in which the first link, second link, and bracket are aligned in substantially in-line relation to support the tray in the work position and a folded position in which the bracket is positioned to lie between the second link pivot point and the leg pivot axis when the tray is in the storage position.

25. The platform stool of claim 23, further comprising a multi-part platform having a front section pivotably coupled to a rear section, the front and rear sections being coupled together for pivoting movement about a platform pivot axis, the front section being pivotably coupled to the front leg at a front pivot axis, the rear section being coupled to the rear leg at a rear pivot axis, the bottom end of the support linkage being coupled to the rear leg between the rear pivot axis and the leg pivot axis.

26. The platform stool of claim 22, further comprising a drawer slidably coupled to the tray and positioned to lie in spaced-apart relation to the leg pivot axis when the drawer is moved to a closed position.

27. The platform stool of claim 26, wherein the tray has a work surface and the drawer is slidably coupled to the tray for movement underneath the work surface without passing through the leg pivot axis.

28. A platform stool comprising a frame including a from leg and a rear leg, the from leg being pivotably coupled to the rear leg at a leg pivot axis for pivoting movement between an opened position wherein a bottom portion of the front leg is spaced apart from a bottom portion of the rear leg and a closed position wherein the front leg is adjacent to the rear leg, a step mounted to the frame, and a tray having a work surface, a side, and an outer edge, the tray being pivotably coupled to the frame at the leg pivot axis for pivoting movement between a work position wherein the outer edge of the tray is spaced apart from the frame and a storage position wherein a portion of the outer edge is adjacent to the frame, the tray being pivotable between the work position and the storage position independently of placement of the platform stool in the opened position and the closed position.

29. The platform stool of claim 28, wherein the step is coupled to the rear leg, the tray is supported in the work position by a support linkage, and the support linkage has a top end pivotably coupled to the tray and a bottom end pivotably coupled to the rear leg between the step and the leg pivot axis.

30. The platform stool of claim 29, wherein the support linkage has a first support link that includes the top end of the support linkage, the support linkage has a second support link that includes the bottom end of the support linkage, and the first support link is pivotably coupled to the second support link for movement between a support position wherein the first support link and the second support link are aligned in substantially end-to-end relation to releasably lock and support the tray in the work position and a folded position wherein the first support link and the second support link are adjacent to the side of the tray and are in angled relation to define an acute angle.

31. The platform stool of claim 30, wherein the support linkage includes a support link bracket coupled to the first and second support links, the support link bracket has a surface that engages the first and second support links when the tray is in the work position to releasably lock the tray in the work position, and the first and second links are substantially parallel to the front leg when the tray is locked in the work position and the front leg is in the opened position.

* * * * *